US009369803B2

(12) United States Patent
Sohn et al.

(10) Patent No.: US 9,369,803 B2
(45) Date of Patent: Jun. 14, 2016

(54) APPARATUS AND METHOD FOR REMOVING NOISE

(71) Applicants: Samsung Electronics Co., Ltd., Suwon-si (KR); Yonsei University Wonju Industry-Academic Cooperation Foundation, Wonju-si (KR)

(72) Inventors: Jun-il Sohn, Yongin-si (KR); Yun-seo Ku, Seoul (KR); Dong-wook Kim, Seoul (KR); Jong-jin Kim, Hwaseong-si (KR); Young-cheol Park, Wonju-si (KR); Heun-chul Lee, Pocheon-si (KR)

(73) Assignees: Samsung Electronics Co., Ltd., Suwon-si (KR); Yonsei University Wonju Industry-Academic Cooperation Foundation, Wonju-si (KR)

( * ) Notice: Subject to any disclaimer, the term of this patent is extended or adjusted under 35 U.S.C. 154(b) by 451 days.

(21) Appl. No.: 13/899,245

(22) Filed: May 21, 2013

(65) Prior Publication Data

US 2013/0315401 A1 Nov. 28, 2013

(30) Foreign Application Priority Data

May 22, 2012 (KR) ..... 10-2012-0054448

(51) Int. Cl.

| | |
|---|---|
| ***H04R 5/00*** | (2006.01) |
| ***H04R 5/04*** | (2006.01) |
| ***H04S 1/00*** | (2006.01) |
| ***H04R 1/10*** | (2006.01) |
| *G10L 21/0216* | (2013.01) |

(52) U.S. Cl.

CPC ..... *H04R 5/04* (2013.01); *H04R 1/1083* (2013.01); *H04R 5/00* (2013.01); *H04S 1/00* (2013.01); *G10L 21/0216* (2013.01)

(58) Field of Classification Search

CPC ..... H04R 3/005; H04R 3/02; H04R 2430/03; H04R 25/453; H04R 1/406; H04R 1/1083; H04R 2499/13; H04R 3/00; H04R 2499/11; H04R 25/407; H04R 2201/405; H04R 2225/43; H04R 2430/20; H04R 5/04; H04R 1/1008; H04R 1/1091; H04R 2201/10; H04R 2430/25; H04R 2460/01; H04R 25/43; H04R 3/04; H04R 5/00; H04R 1/10; G10L 21/0208; G10L 2021/02166; G10L 2021/02082; G10L 2021/02165; G10L 21/02; G10L 21/0232; G10L 15/20; G10L 19/0204; G10L 19/008; G10L 19/26; G10L 2021/02161; G10L 21/0272; G10L 25/18; G10L 19/00; H04M 9/082; H04M 11/062; H04M 3/002; H04M 3/34; H04M 1/60; H04M 3/18; H04S 1/00; H04S 2400/15; H04S 2420/01; H04S 7/30; H04S 7/303; H04S 2420/07; H04S 3/00; H04S 1/002

USPC ..... 381/17, 18, 19, 20, 21, 300, 301, 302, 381/303, 307, 119, 66, 27, 71.1–71.6, 71.9, 381/71.11, 71.12, 26, 318, 86, 92, 94.1, 93, 381/95, 96, 1, 22, 123; 379/406.01–406.16; 455/569.1, 570; 700/94

See application file for complete search history.

(56) References Cited

U.S. PATENT DOCUMENTS

| | | | | |
|---|---|---|---|---|
| 2006/0100867 | A1 | 5/2006 | Lee et al. | |
| 2010/0002886 | A1 | 1/2010 | Doclo et al. | |
| 2011/0307249 | A1 * | 12/2011 | Kellermann | G10L 21/0208 704/226 |

FOREIGN PATENT DOCUMENTS

| | | | |
|---|---|---|---|
| JP | 2002-519973 | A | 7/2002 |
| KR | 10-2005-0119758 | A | 12/2005 |
| KR | 10-2009-0050372 | A | 5/2009 |
| KR | 10-2011-0024969 | A | 3/2011 |

OTHER PUBLICATIONS

Ji et al "Noise Reduction for Binaural Hearing Aids Using Unsupervised Diffuse Noise Estimator", 33rd Annual International Conference of the IEEE EMBS, Boston, Massachusetts USA, Aug. 30-Sep. 3, 2011, p. 7916-7919.*

R. Martin, "Noise Power Spectral Density Estimation Based on Optimal Smoothing and Minimum Statistics," *IEEE Transactions on Speech and Audio Processing*, vol. 9, No. 5, Jul. 2001, pp. 504-512.

I. Cohen et al., "Noise Estimation by Minima Controlled Recursives Averaging for Robust Speech Enhancement," *IEEE Signal Processing Letters*, vol. 9, No. 1, Jan. 2002, pp. 12-15.

I. McCowan et al., "Microphone Array Post-Filter Based on Noise Field Coherence," *IEEE Transactions on Speech and Audio Processing*, vol. 11, No. 6, Nov. 2003, pp. 709-716.

H. Abutalebi et al., "A Hybrid Subband Adaptive System for Speech Enhancement in Diffuse Noise Fields," *IEEE Signal Processing Letters*, vol. 11, No. 1, Jan. 2004, pp. 44-47.

T. Van den Bogaert et al., "Binaural Cue Preservation for Hearing Aids Using an Interaural Transfer Function Multichannel Wiener Filter," *Proceedings of the 2007 IEEE International Conference on Acoustics, Speech, and Signal Processing* (*ICASSP 2007*), vol. IV, pp. 565-568, conference held Apr. 15-20, 2007, Honolulu, Hawaii.

J. Li et al., "Two-stage binaural speech enhancement with Wiener filter for high-quality speech communication," *Speech Communication*, vol. 53, No. 5, May-Jun. 2011, pp. 677-689.

T. Ohkubo et al., "Two-channel-based Noise Reduction in a Complex Spectrum Plane for Hands-free Communication System," *Journal of VLSI Signal Processing*, vol. 46, No. 2-3, Mar. 2007, pp. 123-131, article publication date Jan. 23, 2007.

K. Kim et al., "Extension of two-channel transfer function based generalized sidelobe canceller for dealing with both background and point-source noise," *Speech Communication*, vol. 51, No. 6, Jun. 2009, pp. 521-533.

Extended European Search Report issued on Jan. 5, 2015, in European Application No. 13168723.8 (6 pages, in English).

* cited by examiner

*Primary Examiner* — Leshui Zhang
(74) *Attorney, Agent, or Firm* — NSIP Law

(57) ABSTRACT

A method of removing noise from a two-channel signal includes receiving channel signals constituting the two-channel signal; obtaining a noise signal for each channel by removing a target signal from each channel signal by subtracting another channel signal multiplied by a weighted value from each channel signal; estimating a power spectral density (PSD) of diffuse noise from each channel signal; obtaining a target signal including an interference signal for each channel by removing the diffuse noise from each channel signal using the estimated PSD of the diffuse noise; obtaining the interference signal for each channel by removing the diffuse noise from the noise signal for each channel using the estimated PSD of the diffuse noise; and removing the interference signal from the target signal and the interference signal for each channel.

17 Claims, 4 Drawing Sheets

APPARATUS AND METHOD FOR REMOVING NOISE

CROSS-REFERENCE TO RELATED APPLICATIONS

This application claims the benefit of Korean Patent Application No. 10-2012-0054448 filed on May 22, 2012, in the Korean Intellectual Property Office, the disclosure of which is incorporated herein by reference in its entirety for all purposes.

BACKGROUND

1. Field

This application relates to a method and an apparatus for removing noise from a two-channel sound signal.

2. Description of Related Art

Examples of methods of removing noise from a sound including diffuse noise and interference noise include a two-stage noise removing method using minimum statistics, a minima controlled recursive algorithm (MCRA), a binaural multichannel Wiener filter (MWF), or a voice activity detector (VAD).

SUMMARY

In one general aspect, a method of removing noise from a two-channel signal includes receiving channel signals constituting the two-channel signal; obtaining a noise signal for each channel by removing a target signal from each channel signal by subtracting another channel signal multiplied by a weighted value from each channel signal; estimating a power spectral density (PSD) of diffuse noise from each channel signal; obtaining a target signal including an interference signal for each channel by removing the diffuse noise from each channel signal using the estimated PSD of the diffuse noise; obtaining the interference signal for each channel by removing the diffuse noise from the noise signal for each channel using the estimated PSD of the diffuse noise; and removing the interference signal from the target signal and the interference signal for each channel.

The method may further include determining the weighted value based on directional information of the target signal of each channel signal.

The estimating of the PSD of the diffuse noise may include estimating a coherence between the diffuse noise of each of the channel signals; estimating a minimum eigenvalue of a covariance matrix with respect to the two-channel signal; and estimating the PSD of the diffuse noise using the estimated coherence and the minimum eigenvalue.

The obtaining of the target signal and the interference signal for each channel may include removing the diffuse noise from the channel signals by multiplying the channel signals by a same first diffuse noise removing gain to remove the diffuse noise while maintaining directionality of the channel signals; and the obtaining of the interference signal for each channel may include removing the diffuse noise from the noise signal for each channel by multiplying the noise signal for each channel by a same second diffuse noise removing gain to remove the diffuse noise while maintaining directionality of the noise signal for each channel.

The method may further include obtaining the first diffuse noise removing gain based on a PSD of each channel signal and the estimated PSD of the diffuse noise; and obtaining the second diffuse noise removing gain based on a PSD of the noise signal for each channel, the estimated PSD of the diffuse noise, and directional information of the target signal for each channel.

The method may further include obtaining the PSD of each channel signal through a first-order recursive averaging of each channel signal; and obtaining the PSD of the noise signal for each channel through a first-order recursive averaging of the noise signal for each channel.

The removing of the interference signal may include removing the interference signal by adaptively removing a signal component having a high coherence with the interference signal from the target signal and the interference signal for each channel using an adaptive filter.

The adaptive filter may be configured using a normalized least means square (NLMS) algorithm.

In another general aspect, a non-transitory computer-readable storage medium stores a computer program for controlling a computer to perform the method described above.

In another general aspect, a noise removing apparatus for removing noise from a two-channel signal includes a receiving unit configured to receive channel signals constituting the two-channel signal; a target signal removing unit configured to obtain a noise signal for each channel by removing a target signal from each channel signal by subtracting another channel signal multiplied by a weighted value from each channel signal; a diffuse noise estimating unit configured to estimate a power spectral density (PSD) of diffuse noise from each channel signal; a first diffuse noise removing unit configured to obtain a target signal including an interference signal for each channel by removing the diffuse noise from each channel signal using the estimated PSD of the diffuse noise; a second diffuse noise removing unit configured to obtain the interference signal for each channel by removing the diffuse noise from the noise signal for each channel using the estimated PSD of the diffuse noise; and an interference signal removing unit configured to remove the interference signal from the target signal and the interference signal for each channel.

The target signal removing unit may be further configured to determine the weighted value based on directional information of the target signal of each channel signal.

The diffuse noise estimating unit may be further configured to estimate a coherence between the diffuse noise of each of the channel signals; estimate a minimum eigenvalue of a covariance matrix with respect to the two-channel signal; and estimate a PSD of the diffuse noise using the estimated coherence and the estimated minimum eigenvalue.

The first diffuse noise removing unit may be further configured to remove the diffuse noise from the channel signals by multiplying the channel signals by a same first diffuse noise removing gain to remove the diffuse noise while maintaining directionality of the channel signals; and the second diffuse noise removing unit may be further configured to remove the diffuse noise from the noise signal for each channel by multiplying the noise signal for each channel by a same second diffuse noise removing gain to remove the diffuse noise while maintaining directionality of the noise signal for each channel.

The first diffuse noise removing unit may be further configured to obtain the first diffuse noise removing gain based on the PSD of each channel signal and the estimated PSD of the diffuse noise; and the second diffuse noise removing unit may be further configured to obtain the second diffuse noise removing gain based on the PSD of the noise signal for each channel, the estimated PSD of the diffuse noise, and directional information of the target signal for each channel.

The interference signal removing unit may be further configured to remove the interference signal by adaptively removing a signal component having a high coherence with the interference signal from the target signal and the interference signal for each channel using an adaptive filter.

In another general aspect, a sound output apparatus for outputting a two-channel sound from which noise is removed includes a receiving unit configured to receive channel signals constituting the two-channel signal, a processor configured to obtain a noise signal for each channel by removing a target signal from each channel signal by subtracting another channel signal multiplied by a weighted value from each channel signal, estimate a power spectral density (PSD) of the diffuse noise from each channel signal, obtain a target signal including an interference signal for each channel by removing the diffuse noise from each channel signal using the estimated PSD of the diffuse noise, obtain the interference signal for each channel by removing the diffuse noise from the noise signal for each channel using the estimated PSD of the diffuse noise, obtain the target signal for each channel by removing the interference signal from the target signal and the interference signal for each channel, and obtain an output gain applied to each channel signal based on the obtained target signal; a gain application unit configured to apply the output gain to each channel signal; and a sound output unit configured to output a two-channel sound to which the output gain is applied.

The gain application unit may be further configured to apply the same output gain to each channel signal to remove noise while maintaining a directionality of each channel signal.

The processor may be further configured to obtain the weighted value based on directional information of the target signal of each channel signal.

The processor may be further configured to estimate a coherence between the diffuse noise of each of the channel signals, estimate a minimum eigenvalue of a covariance matrix with respect to the two-channel signal, and estimate the PSD of the diffuse noise using the estimated coherence and the estimated minimum eigenvalue.

The processor may be further configured to remove the interference signal by adaptively removing a signal component having a high coherence with the interference signal from the target signal and the interference signal for each channel using an adaptive filter.

In another general aspect, a method of removing noise from a multi-channel signal includes receiving channel signals constituting the multi-channel signal; obtaining a noise signal for each channel by removing a target signal from each channel signal by subtracting a signal based on another channel signal from each channel signal; obtaining a target signal including an interference signal for each channel by removing diffuse noise from each channel signal; obtaining the interference signal for each channel by removing the diffuse noise from the noise signal for each channel; and removing the interference signal from the target signal and the interference signal for each channel.

The method may further include obtaining the signal based on another channel signal by multiplying the other channel signal by a weighted value.

The weighted value may depend on directional information of the target signal of each channel.

The method may further include estimating a power spectral density (PSD) of the diffuse noise from each channel signal; wherein the obtaining of a target signal including an interference signal for each channel may include removing the diffuse noise from each channel signal using the estimated PSD of the diffuse noise; and the obtaining of the interference signal for each channel may include removing the diffuse noise from the noise signal for each channel using the estimated PSD of the diffuse noise.

Other features and aspects will be apparent from the following detailed description, the drawings, and the claims.

DETAILED DESCRIPTION

Figure 1:
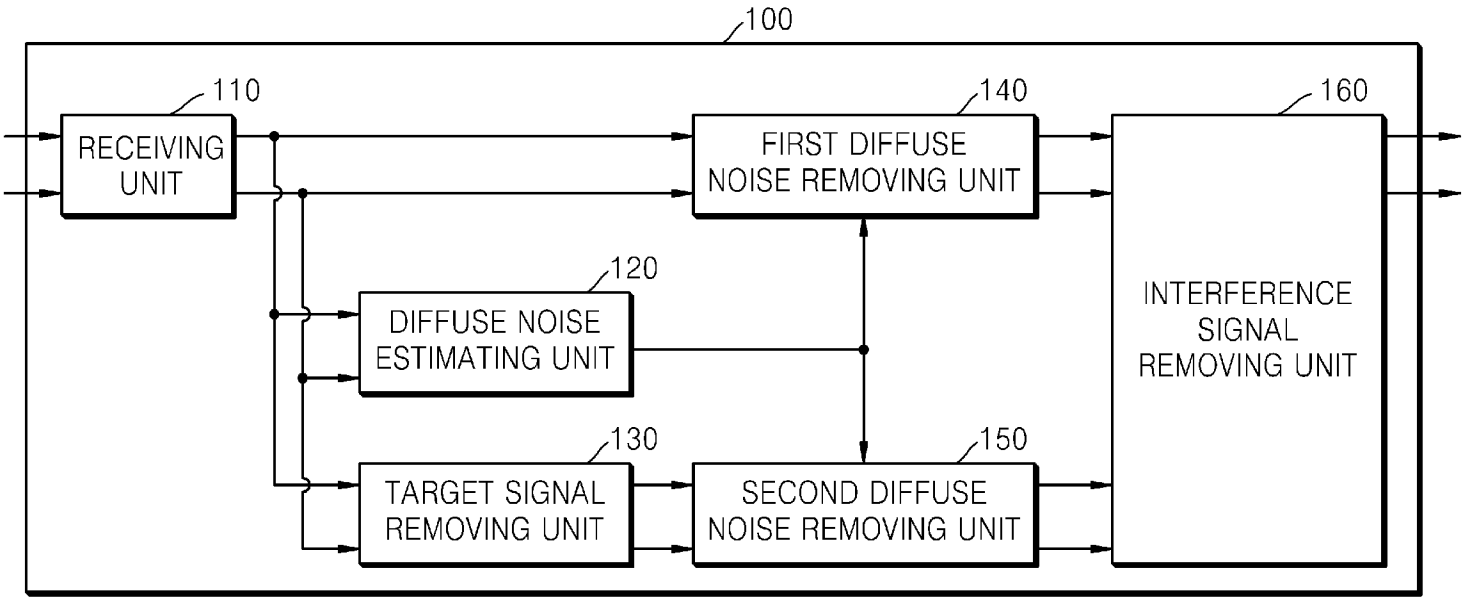
FIG. 1 is a block diagram of an example of a noise removing apparatus.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, description of functions and constructions that are well known to one of ordinary skill in the art may be omitted for increased clarity and conciseness.

Throughout the drawings and the detailed description, the same reference numerals refer to the same elements. The drawings may not be to scale, and the relative size, proportions, and depiction of elements in the drawings may be exaggerated for clarity, illustration, and convenience.

FIG. 1 is a block diagram of an example of a noise removing apparatus 100. Referring to FIG. 1, the noise removing apparatus 100 includes a receiving unit 110, a diffuse noise estimating unit 120, a target signal removing unit 130, a first diffuse noise removing unit 140, a second diffuse noise removing unit 150, and an interference signal removing unit 160.

FIG. 1 showing the noise removing apparatus 100 includes only components related to the current example so as not to hinder the understanding thereof. Thus, one of ordinary skill in the art would understand that the noise removing apparatus 100 may include other general-purpose components in addition to the components shown in FIG. 1.

The noise removing apparatus 100 of the current example may be at least one processor or may include at least one processor. Thus, the noise removing apparatus 100 of the current example may be driven in the form of an apparatus included in another hardware device, such as a sound reproducing apparatus, a sound output apparatus, or a hearing aid.

The receiving unit 110 receives channel signals such as a two-channel signal. The channel signal is a signal into which a sound around a user is input via two audio channels. The channel signals are different from each other according to a location where the channel signals are input.

According to the current example, the two-channel signal may be sound input at positions of both ears of a user. For example, the two-channel signal may be sound input via microphones respectively placed at both ears of the user, but the current example is not limited thereto. For convenience of description, the two-channel signal is referred to as sound input at positions of both ears of the user. The sound input at a position of the user's left ear is referred to as a left channel signal, and the sound input at a position of the user's right ear is referred to as a right channel signal.

The channel signal includes a target signal corresponding to sound that a user intends to listen to, and a noise signal in addition to the target signal. Noise is sound hindering listening of a user, and the noise signal may be divided into diffuse noise corresponding to noise having no directionality, and interference signal corresponding to noise having directionality.

For example, if a user talks with someone, the other party's voice is a target signal, and sound except for the other party's voice corresponds to noise. Also, other people's voices except for the other party's voice is an interference signal, that is, noise having directionality, and surrounding sound having not directionality corresponds to diffuse noise.

Thus, the receiving unit 110 receives channel signals for two channels including a target signal, an interference signal, and diffuse noise, and each channel signal may be represented by Equation 1 below.

$$X_L=\alpha_L S+v_L V+N_L$$

$$X_R=\alpha_R S+v_R V+N_R \quad (1)$$

In Equation 1, $X_L$ denotes a left channel signal input at a position of a user's left ear, and $X_R$ denotes a right channel signal at a position of a user's right ear. As described above, the left channel signal $X_L$ is represented by the sum of $\alpha_L S$, which is an element of the target signal, $v_L V$, which is an element of the interference signal, and $N_L$, which is an element of the diffuse noise. The description with respect to the left channel signal $X_L$ may also be used to describe the right channel signal $X_R$.

In this regard, the target signal having directionality is represented with an acoustic path along which a sound is transferred from a location where the sound is generated to a location where the sound is input. That is, the acoustic path refers to information representing a direction of the sound.

According to the current example, the acoustic path may be represented by a head-related transferred function (HRTF), but the current example is not limited thereto. Hereinafter, for convenience of description, $\alpha_L$ and $\alpha_R$ may be referred to as an HRTF representing a transfer path from a location where the sound is generated to both ears of a user.

As shown in Equation 1, the target signal included in the left channel signal $X_L$ may be represented by a value obtained by multiplying a sound S corresponding to the target signal by the HRTF $\alpha_L$ representing a transfer path from a location where the sound is generated to both ears of the user.

Similarly, the interference signal, which is a signal having directionality, may be represented by a value obtained by multiplying a sound V of the interference signal by $v_L$ or $v_R$ representing a transfer path from a location where the interference signal is generated to a location where the interference signal is input. According to the current example, $v_L$ or $v_R$ may be the HRTF representing a transfer path from a location where the sound is generated to both ears of the user.

On the other hand, the diffuse noise is a signal having no directionality, and may be represented by only $N_L$ or $N_R$ without including directional information as shown in Equation 1.

Thus, the noise removing apparatus 100 of the current example removes the interference signal and the diffuse noise corresponding to noise from the channel signal including the target signal, the interference signal, and the diffuse noise that are received via the receiving unit 110.

The diffuse noise estimating unit 120 estimates a power spectral density (PSD) of the diffuse noise from the channel signal. In this regard, the diffuse noise refers to noise from an ambient environment, and may also be referred to as background noise or ambient noise. The diffuse noise has no directionality, has a uniform size in all directions, and has a random phase. For example, the diffuse noise may be machine noise made by an air conditioner or a motor, indoor babble noise, or reverberation.

The diffuse noise estimating unit 120 estimates the coherence between the diffuse noise included in the channel signals, estimates a minimum eigenvalue of a covariance matrix with respect to the channel signals, and also estimates a PSD of the diffuse noise using the estimated coherence and the minimum eigenvalue.

The diffuse noise estimating unit 120 may estimate the PSD of the diffuse noise using a minimum eigenvalue of the covariance matrix of the left channel signal $X_L$ and the right channel signal $X_R$. In this regard, the diffuse noise refers to noise having no directionality and having a uniform size in all directions. Although the overall coherence between the diffuse noise included in the channel signals is low, the coherence between the diffuse noise included in the channel signals in a low frequency band is high.

Thus, the diffuse noise estimating unit 120 needs to mathematically model the coherence between the diffuse noise included in the channel signals and compensate for the high coherence between the diffuse noise included in the channel signals in the low frequency band. Accordingly, the diffuse noise estimating unit 120 estimates coherence of the diffuse noise element $N_L$ included in the left channel signal $X_L$ and the diffuse noise element $N_R$ included in the right channel signal $X_R$, and uses the estimated coherence to estimate the PSD of diffuse noise. The estimated PSD of the diffuse noise is represented by $\Gamma_{NN}$, which will be described in detail with reference to FIG. 2.

The target signal removing unit 130 obtains a noise signal for each channel by removing the target signal from each channel signal by subtracting another channel signal multiplied by a weighted value from each channel signal. In this regard, the weighted value is determined to allow the target signal included in each channel to be the same as the target signal included in another channel. Thus, the target signal included in each channel may be removed.

The removing of the target signal included in each channel signal by the target signal removing unit 130 may be represented by Equation 2 below.

$$Z_L=X_L-W_R X_R$$

$$Z_R=X_R-W_L X_L \quad (2)$$

In Equation 2, $W_R$ and $W_L$ denote a weighted value, and $Z_L$ and $Z_R$ denote a channel signal from which a target signal is removed, that is, a noise signal. As shown in Equation 2, the target signal removing unit 130 may remove the target signal included in a left channel signal $X_L$ by subtracting a right channel signal $X_R$ multiplied by a weighted value $W_R$ from the left channel signal $X_L$, and may obtain a noise signal $Z_L$ included in the left channel signal $X_L$. Similarly, a noise signal $Z_R$ of a right channel may be obtained by subtracting the left channel signal $X_L$ multiplied by a weighted value $W_L$ from a right channel signal $X_R$.

Referring to Equation 1, a target signal element $\alpha_L S$ is removed from the left channel signal $X_L$ by the target signal removing unit 130, and only a noise element remains. In other words, the noise signal obtained by subtracting the right channel signal $X_R$ multiplied by the weighted value $W_R$ from the left channel signal $X_L$ may be represented by Equation 3 below.

$$\begin{aligned} Z_L &= X_L - W_R X_R \\ &= H_L V + N_L' \\ Z_R &= X_R - W_L X_L \\ &= H_R V + N_R' \end{aligned} \tag{3}$$

In Equation 3, $H_L V$ and $N_L'$ denote signals obtained by subtracting the right channel signal $X_R$ multiplied by a weighted value $W_R$ from the left channel signal $X_L$, and $H_R V$ and $N_R'$ denote signals obtained by subtracting the left channel signal $X_L$ multiplied by a weighted value $W_L$ from the right channel signal $X_R$. That is, $H_L V$ $N_L'$, $H_R V$, and $N_R'$ denote noise elements to which a weighted value is applied. $H_L$ and $H_R$ are values that are multiplied by the sound V of the interference signal. $H_L V$ and $H_R V$ denote values obtained by applying a weighted value to interference signal elements $v_L V$ and $v_R V$. $N_L'$ and $N_R'$ are values obtained by applying a weighted value to diffuse noise elements $N_L$ and $N_R$.

In this regard, the weighted value of the target signal removing unit 130 may be obtained based on directional information of the target signal included in each channel signal according to the current example. For example, the target signal removing unit 130 may determine a weighted value causing the target signal included in each channel signal to be the same as the target signal included in another channel signal using the HRTF $\alpha_L$ and $\alpha_R$ indicating directional information of the target signal.

Referring to Equation 1, the target signal elements included in the channel signals $X_L$ and $X_R$ are respectively $\alpha_L S$ and $\alpha_R S$ in which the HRTF $\alpha_L$ and $\alpha_R$ indicating directional information of the target signal are multiplied by the sound S. Thus, the target signal removing unit 130 determines a weighted value multiplied by the target signal element $\alpha_R S$ included in the right channel using the HRTF $\alpha_L$ and $\alpha_R$ so that the target signal element of the right channel is the same as the target signal element $\alpha_L S$ included in the left channel signal $X_L$.

The weighted value of the target signal removing unit 130 determined using the HRTF $\alpha_L$ and $\alpha_R$ indicating the directional information of the target signal is represented by Equation 4 below.

$$\begin{aligned} W_R &= \alpha_L \alpha^*_R / |\alpha_R|^2 \\ W_L &= \alpha_R \alpha^*_L / |\alpha_L|^2 \end{aligned} \tag{4}$$

In Equation 4, $W_R$ denotes a weighted value set in such a way that the target signal element of the right channel is the same as the target signal element included in the left channel signal. On the other hand, $W_L$ denotes a weighted value set in such a way that the target signal element of the left channel is the same as the target signal element included in the right channel signal. Thus, the target signal elements $\alpha_L S$ and $\alpha_R S$ included in the channel signals $X_L$ and $X_R$ may be removed by subtracting another channel signal multiplied by the weighted values $W_R$ and $W_L$ from the channel signals $X_L$ and $X_R$.

The directional information of the target signal is a value that is previously input to the noise removing apparatus 100. The directional information of the target signal may be obtained by detecting a difference in time and loudness between sounds reaching a microphone using a directional microphone. Alternatively, directional information of the target signal may be a value determined and stored on the assumption that is the target signal is constantly generated at the front. However, an algorithm for detecting the directional information of the target signal is not limited thereto, and it would be obvious to one of ordinary skill in the art that the directional information of the target signal may be obtained by various algorithms known to one of ordinary skill in the art for detecting a direction in which a sound is generated.

The first diffuse noise removing unit 140 obtains the target signal and the interference signal for each channel by removing the diffuse noise from each channel signal using the estimated PSD of the diffuse noise. Thus, the first diffuse noise removing unit 140 obtains target signals $Y_L$ and $Y_R$ including the interference signal for each channel, which is a signal from which the diffuse noise is removed from the channel signals $X_L$ and $X_R$, using $\Gamma_{NN}$ which is the estimated PSD of the diffuse noise.

In this regard, the first diffuse noise removing unit 140 removes the diffuse noise from each channel signal by multiplying each channel signal by the same first diffuse noise removing gain $G^b$ to remove the diffuse noise while maintaining directionality of the channel signal. The target signals $Y_L$ and $Y_R$ including the interference signal for each channel obtained by the first diffuse noise removing unit 140 may be represented by Equation 5 below.

$$\begin{aligned} Y_L &= G^b \cdot X_L \\ Y_R &= G^b \cdot X_R \end{aligned} \tag{5}$$

The first diffuse noise removing gain $G^b$ by which the channel signals $X_L$ and $X_R$ are both multiplied may be obtained using Equation 6 below.

$$G^b = \sqrt{G_L{}^b G_R{}^b} \tag{6}$$

In Equation 6, $G^b{}_L$ and $G^b{}_R$ denote a first diffuse noise removing gain for each channel. The first diffuse noise removing gain $G^b$ by which the channel signals are both multiplied may be obtained using a geometric mean with respect to the first diffuse noise removing gain for each channel. As such, the first diffuse noise removing unit 140 may remove the diffuse noise from each channel signal while maintaining directionality of each channel signal by removing diffuse noise from each channel signal using the geometric mean of the first diffuse noise removing gain for each channel.

The first diffuse noise removing gain for each channel is obtained based on a PSD of each channel signal and the estimated PSD of the diffuse noise. Accordingly, the first diffuse noise removing gains $G^b{}_L$ and $G^b{}_R$ for each channel may be obtained using Equation 7 below.

$$\begin{aligned} G_L{}^b &= \Gamma_{YY}{}^L / \Gamma_{XX}{}^L \\ G_R{}^b &= \Gamma_{YY}{}^R / \Gamma_{XX}{}^R \end{aligned} \tag{7}$$

In Equation 7, $\Gamma_{YY}{}^L$ and $\Gamma_{YY}{}^R$ denote a PSD of the target signal and the interference signal for each channel, and $\Gamma_{XX}{}^L$ and $\Gamma_{XX}{}^R$ denote a PSD of each channel signal. Thus, the first diffuse noise removing gains $G^b{}_L$ and $G^b{}_R$ for each channel refer to a PSD ratio of the PSD of the target signal and the interference signal for each channel to the PSD of each channel signal.

According to the current example, the PSDs $\Gamma_{XX}^{L}$ and $\Gamma_{XX}^{R}$ may be obtained through a first-order recursive averaging of the received channel signals $X_L$ and $X_R$. However, the current example is not limited thereto, and the PSD of each channel signal may be obtained using any of various other algorithms that are well known to one of ordinary skill in the art.

$\Gamma_{YY}^{L}$ and $\Gamma_{YY}^{R}$, which are the PSD of the target signal and the interference signal for each channel, may be obtained using $\Gamma_{XX}^{L}$ and $\Gamma_{XX}^{R}$, which are the PSD of each channel signal, and the estimated PSD of the diffuse noise $\Gamma_{NN}$. $\Gamma_{XX}^{L}$ and $\Gamma_{XX}^{R}$, which are the PSD of each channel signal, may be represented by Equation 8 below.

$$\Gamma_{XX}^{L}=|\alpha_L|^2\Gamma_{SS}+|\nu_L|^2\Gamma_{VV}+\Gamma_{NN}$$

$$\Gamma_{XX}^{R}=|\alpha_R|^2\Gamma_{SS}+|\nu_R|^2\Gamma_{VV}+\Gamma_{NN} \quad (8)$$

In Equation 8, the PSD of each channel signal is comprised of the sum of the PSD of the target signal element, the PSD of the interference signal element, and the PSD of the diffuse noise included in each channel signal. Thus, the PSD of the target signal and the interference signal for each channel may be obtained by removing the PSD of the diffuse noise from the PSD of each channel signal. In other words, the PSD of the target signal and the interference signal for each channel may be obtained using Equation 9 below.

$$\Gamma_{YY}^{L}=\Gamma_{XX}^{L}-\Gamma_{NN}$$

$$\Gamma_{YY}^{R}=\Gamma_{XX}^{R}-\Gamma_{NN} \quad (9)$$

In Equation 9, $\Gamma_{YY}^{L}$ and $\Gamma_{YY}^{R}$ which are the PSD of the target signal and the interference signal for each channel refer to a value obtained by subtracting $\Gamma_{NN}$, which is the estimated PSD of the diffuse noise, from $\Gamma_{XX}^{L}$ and $\Gamma_{XX}^{R}$ which are the PSD of each channel signal. Thus, the first diffuse noise removing unit 140 may obtain the PSD of each channel signal and the PSD of the target signal and the interference signal for each channel.

The first diffuse noise removing unit 140 may obtain the target signal and the interference signal for each channel, which is a signal from which the diffuse noise is removed from each channel signal, by removing diffuse noise from each channel signal as described above.

The second diffuse noise removing unit 150 obtains an interference signal for each channel by removing diffuse noise from a noise signal for each channel using the estimated PSD of the diffuse noise. Thus, the second diffuse noise removing unit 150 obtains $I_L$ and $I_R$, which are interference signals for each channel, using $\Gamma_{NN}$, which is the estimated PSD of the diffuse noise, wherein the interference signals are signals from which diffuse noise is removed from noise signals $Z_L$ and $Z_R$ for each channel.

In this regard, the second diffuse noise removing unit 150 removes the diffuse noise from the noise signal for each channel by multiplying the noise signal for each channel by the same second diffuse noise removing gain $G^c$ to remove the diffuse noise while maintaining directionality of the noise signal for each channel. $I_L$ and $I_R$, which are the interference signals for each channel, obtained by the second diffuse noise removing unit 150 may be represented by Equation 10 below.

$$I_L=G^c\cdot Z_L$$

$$I_R=G^c\cdot Z_R \quad (10)$$

In this regard, the second diffuse noise removing gain $G^c$ by which the noise signals $Z_L$ and $Z_R$ for each channel are both multiplied may be obtained using Equation 11 below.

$$G^c=\sqrt{G_L{}^c G_R{}^c} \quad (11)$$

In Equation 11, $G^c{}_L$ and $G^c{}_R$ denote a second diffuse noise removing gain for each channel. The second diffuse noise removing gain $G^c$ by which the noise signals $Z_L$ and $Z_R$ for each channel are both multiplied may be obtained a geometric mean of the second diffuse noise removing gain for each channel. As such, the second diffuse noise removing unit 150 may remove the diffuse noise from the noise signal for each channel while maintaining directionality of the noise signal for each channel by removing diffuse noise from the noise signal for each channel using the geometric mean the second diffuse noise removing gain for each channel.

The second diffuse noise removing gain for each channel is obtained based on the PSD of the noise signal for each channel and the estimated PSD of the diffuse noise. Thus, the second diffuse noise removing gain $G^c{}_L$ and $G^c{}_R$ for each channel may be obtained using Equation 12 below.

$$G_L{}^c=\Gamma_{II}^{L}/\Gamma_{ZZ}^{L}$$

$$G_R{}^c=\Gamma_{II}^{R}/\Gamma_{ZZ}^{R} \quad (12)$$

In Equation 12, $\Gamma_{II}^{L}$ and $\Gamma_{II}^{R}$ denote the PSD of the interference signal for each channel, and $\Gamma_{ZZ}^{L}$ and $\Gamma_{ZZ}^{R}$ denote the PSD of the noise signal for each channel. Thus, the second diffuse noise removing gain $G^c{}_L$ and $G^c{}_R$ for each channel refer to a PSD ratio of the PSD of the interference signal for each channel to the PSD of the noise signal for each channel.

According to the current example, $\Gamma_{ZZ}^{L}$ and $\Gamma_{ZZ}^{R}$, which are the PSD of the noise signal for each channel, may be obtained through a first-order recursive averaging of the noise signals $Z_L$ and $Z_R$ for each channel obtained by the target signal removing unit 130. However, the current example is not limited thereto, and the PSD of the noise signal for each channel may be obtained using any of various other algorithms known to one of ordinary skill in the art.

$\Gamma_{II}^{L}$ and $\Gamma_{II}^{R}$ which are the PSD of the interference signal for each channel, may be obtained using $\Gamma_{ZZ}^{L}$ and $\Gamma_{ZZ}^{R}$, which are the PSD of the noise signal for each channel, and the estimated diffuse noise $\Gamma_{NN}$. $\Gamma_{ZZ}^{L}$ and $\Gamma_{ZZ}^{R}$, which are the PSD of the noise signal for each channel, may be represented by Equation 13 below.

$$\Gamma_{ZZ}^{L}=|H_L|^2\Gamma_{VV}+\Gamma_{N'_LN'_L}$$

$$\Gamma_{ZZ}^{R}=|H_R|^2\Gamma_{VV}+\Gamma_{N'_RN'_R} \quad (13)$$

In Equation 13, the PSD of the noise signal for each channel is comprised of the sum of a PSD of an interference signal element and a PSD of a diffuse noise element. Thus, similar to the first diffuse noise removing unit 140, the second diffuse noise removing unit 150 may obtain the PSD of the interference signal for each channel by removing the PSD of the diffuse noise element from the PSD of the noise signal for each channel.

However, in Equation 13, $\Gamma_{N'_LN'_L}$ and $\Gamma_{N'_RN'_R}$ corresponding to the PSD of the diffuse noise element are values to which the weighted value of the target signal removing unit 130 is applied, and $\Gamma_{N'_LN'_L}$ and $\Gamma_{N'_RN'_R}$ are different from $\Gamma_{NN}$, which is the estimated PSD of the diffuse noise. Also, the PSD of the interference signal element of Equation 13 includes a value to which the weighted value of the target signal removing unit 130 is applied. Thus, the second diffuse noise removing unit 150 should remove the diffuse noise element to which the weighted value of the target signal removing unit 130 is applied from $\Gamma_{ZZ}^{L}$ and $\Gamma_{ZZ}^{R}$, which are the PSD of the noise signal for each channel. Accordingly, the PSD of the interference signal for each channel may be obtained using Equation 14 below.

$$\Gamma_{II}^{L}=\Gamma_{ZZ}^{L}-(1+|W_R|^2)\Gamma_{NN}$$

$$\Gamma_{II}^{R}=\Gamma_{ZZ}^{R}-(1+|W_L|^2)\Gamma_{NN} \quad (14)$$

In Equation 14, $\Gamma_{II}^{L}$ and $\Gamma_{II}^{R}$, which are the PSD of the interference signal for each channel, refer to values obtained by scaling $\Gamma_{NN}$, which is the estimated PSD of the diffuse noise, by $1+|W_R|^2$ and $1+|W_L|^2$, and subtracting the scaled values from $\Gamma_{ZZ}^{L}$ and $\Gamma_{ZZ}^{R}$, which are the PSD of the noise signal for each channel. In this regard, the estimated PSD of the diffuse noise is scaled because the weighted value of the target signal removing unit 130 is applied to the diffuse noise during the process of removing the target signal from each channel signal by the target signal removing unit 130. Thus, the second diffuse noise removing unit 150 may obtain the PSD of the noise signal for each channel and the PSD of the interference signal for each channel.

The second diffuse noise removing unit 150 may obtain the interference signal for each channel by removing the diffuse noise from the noise signal for each channel as described above.

The interference signal removing unit 160 obtains the target signal by removing the interference signal from the target signal and the interference signal for each channel. The interference signal removing unit 160 receives $\Gamma_{YY}^{L}$ and $\Gamma_{YY}^{R}$, the target signal and the interference signal for each channel, from the first diffuse noise removing unit 140 as inputs, receives $\Gamma_{II}^{L}$ and $\Gamma_{II}^{R}$, the interference signal for each channel, from the second diffuse noise removing unit 150 as inputs, and outputs the target signal.

The interference signal removing unit 160 of the current example may remove the interference signal by adaptively removing a signal element having a high coherence with the interference signal from the target signal and the interference signal for each channel using an adaptive filter.

The interference signal removing unit 160 uses the target signal and the interference signal, from which diffuse noise is removed, and the interference signal inputs of the adaptive filter. Thus, the noise removing apparatus 100 of the current example may solve a problem in which an adaptive filter for removing only a signal element having a high coherence may not effectively remove the interference signal included in each channel signal due to diffuse noise having a low coherence between channels.

According to the current example, the adaptive filter may be configured using a normalized least means square (NLMS) algorithm. However, the current example is not limited thereto, and it would be obvious to one of ordinary skill in the art that the adaptive filter may be configured using any of various other algorithms known to one of ordinary skill in the art.

A process of removing the interference signal from the target signal from which noise is removed using the adaptive filter performed by the interference signal removing unit 160 may be represented by Equation 15 below.

$$\hat{E}_i=Y_i-A_i^l\cdot I_i,\ i=L,R \quad (15)$$

In Equation 15, $\hat{E}_i$ denotes a target signal obtained by removing the interference signal by the interference signal removing unit 160, $Y_i$ denotes a target signal and the interference signal, and $I_i$ denotes the interference signal. In this regard, $A_i^l$ denotes a weighted value used to remove the interference signal by the interference signal removing unit 160, wherein I of the weighted value $A_iI$ denotes a frame index. The weighted value $A_i^l$ of the interference signal removing unit 160 may be obtained using Equation 16 below.

$$A_i^{l+1}=A_i^l+\mu\frac{I_i^*}{\hat{\Gamma}_{II}^i}\cdot\hat{E}_i \quad (16)$$

In Equation 16, the weighted value $A_i^l$ denotes a weighted value of the current frame, and $A_i^{l+1}$ denotes a weighted value of the next frame. Also, μ denotes a step size of an adaptive filter. And, $\hat{\Gamma}_{II}^i$ denotes an estimated value of $\Gamma_{II}^i$, the PSD of the interference signal for channel i. Thus, $\Gamma_{II}^i$ may be $\Gamma_{II}^{L}$ or $\Gamma_{II}^{R}$. According to Equation 16, the weighted value $A_i^l$ of the current frame is used to obtain the weighted value $A_i^{l+1}$ of the next frame. Thus, the weighted value of the interference signal removing unit 160 is obtained based on a weighted value of the previous frame, the target signal, and the interference signal.

The noise removing apparatus 100 according to the current example estimates the diffuse noise and the interference signal in each channel signal using each channel signal configured as a two-channel signal, and removes the interference signal and the diffuse noise, which are noise elements, from the channel signal based on the estimated diffuse noise and the estimated interference signal. Thus, the noise removing apparatus 100 may easily and effectively remove noise without performing a large number of operations as is necessary in a multichannel Wiener filter (MWF) performing an operation using a plurality of input signals.

Also, the noise removing apparatus 100 obtains remaining signals, obtained by removing the estimated diffuse noise from the noise signal which is obtained by removing the target signal, as an interference signal. Thus, the noise removing apparatus 100 may easily and effectively remove all interference elements without performing a complex operation, as is necessary in a voice activity detector (VAD), even though more than two interference signals exist.

In addition, the noise removing apparatus 100 may effectively remove noise while maintaining directionality of each channel signal without causing a loss of a spatial cue parameter such as an interaural level difference (ILD) and an interaural time difference (ITD) between channels by multiplying each channel signal by the same gain.

Figure 2:
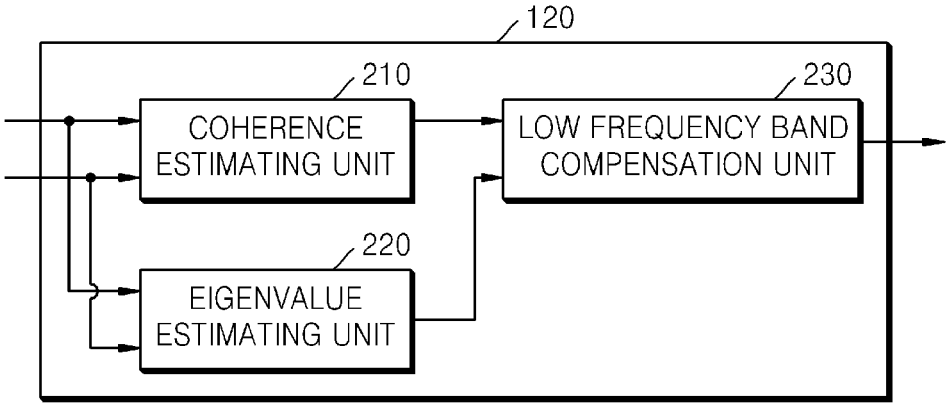
FIG. 2 is a block diagram of an example of a diffuse noise estimating unit of FIG. 1.

FIG. 2 is a block diagram of an example of the diffuse noise estimating unit 120 of FIG. 1. Referring to FIG. 2, the diffuse noise estimating unit 120 includes a coherence estimating unit 210, an eigenvalue estimating unit 220, and a low frequency band compensation unit 230.

The diffuse noise estimating unit 120 shown in FIG. 2 includes only components related to the current example. Thus, one of ordinary skill in the art would understand that the diffuse noise estimating unit 120 may include other general-purpose components in addition to the components shown in FIG. 2.

The description of the diffuse noise estimating unit 120 of FIG. 1 is also applicable to the diffuse noise estimating unit 120 of FIG. 2, and thus a repeated description thereof will be omitted here.

The diffuse noise estimating unit 120 estimates a PSD of diffuse noise from each channel signal as described above with reference to FIG. 1. The diffuse noise estimating unit 120 estimates a coherence between diffuse noise included in each channel signal, estimates a minimum eigenvalue value of a covariance matrix with respect to the channel signals, and estimates the PSD of diffuse noise using the estimated coherence and the estimated minimum eigenvalue value.

The coherence estimating unit 210 estimates a coherence between diffuse noise included in each channel signal. In this regard, the coherence between the diffuse noise included in a left channel signal and the diffuse noise included a right channel signal may be represented by Equation 17 below.

$$\Psi = \frac{\Gamma_{NN}^{LR}}{\sqrt{\Gamma_{NN}^{L}\Gamma_{NN}^{R}}} = \frac{\Gamma_{NN}^{LR}}{\Gamma_{NN}} \tag{17}$$

In Equation 17, $\psi$ denotes a coherence between the diffuse noise included in the left channel signal and the diffuse noise included in the right channel signal, $\Gamma_{NN}$ denotes a PSD of diffuse noise, $\Gamma_{NN}^{L}$ denotes a PSD of the diffuse noise included in the left channel signal, $\Gamma_{NN}^{R}$ denotes a PSD of the diffuse noise included in the right channel signal, and $\Gamma_{NN}^{LR}$ denotes a PSD of the diffuse noise included in the left channel signal and the right channel signal. In this regard, $\Gamma_{NN}^{LR}$ may denote an average value obtained by multiplying the diffuse noise included in the left channel signal by the diffuse noise included in the right channel signal, but the current example is not limited thereto.

In this regard, the coherence $\psi$ between the diffuse noise included in the left channel signal and the diffuse noise included in the right channel signal may be a coherence function between the left channel signal and the right channel signal.

Thus, the coherence $\psi$ between the diffuse noise in each of the left channel signal and the right channel signal may be defined as a ratio of $\Gamma_{NN}$, which is the PSD of the diffuse noise, to $\Gamma_{NN}^{LR}$, which is the PSD of the diffuse noise included in the left channel signal and the right channel signal.

As described above, the diffuse noise included in the left channel signal and the diffuse noise included in the right channel signal have a higher coherence in a low frequency band than in a high frequency band. Thus, $\Gamma_{NN}^{LR}$, which is the PSD of the diffuse noise included in the left channel signal and the right channel signal, has a value close to 0 toward the high frequency band from the low frequency band.

Accordingly, the coherence estimating unit 210 estimates the coherence so that the diffuse noise included in each channel signal has a higher weighted value in the low frequency band than in the high frequency band.

For example, the coherence estimating unit 210 may estimate the coherence using a sinc function according to a frequency and a distance between locations where the channel signals are input. Accordingly, the coherence between the estimated diffuse noise may be defined by Equation 18 below.

$$\Psi = \mathrm{sinc}\left(\frac{2\pi f d_{LR}}{c}\right) \tag{18}$$

In Equation 18, $\psi$ denotes a coherence, f denotes a frequency, $d_{LR}$ denotes a distance between locations where the channel signals are input, and c denotes a speed of sound.

As such, the coherence estimating unit 210 may estimate the coherence between the diffuse noise using the sinc function according to a frequency and a distance between locations where the channel signals are input.

The eigenvalue estimating unit 220 estimates an eigenvalue of a covariance matrix using each channel signal. The eigenvalue estimating unit 220 may estimate a covariance matrix with respect to a two-channel signal of the left channel signal and the right channel signal as shown in Equation 19 below.

$$R_x = \begin{bmatrix} \alpha_L|^2\Gamma_{SS}^2 + \Gamma_{NN} & \alpha_L\alpha_R^*\Gamma_{SS} + \Psi\Gamma_{NN} \\ \alpha_R\alpha_L^*\Gamma_{SS} + \Psi\Gamma_{NN} & \alpha_R|^2\Gamma_{SS}^2 + \Gamma_{NN} \end{bmatrix} \tag{19}$$

In Equation 19, $R_x$ denotes a covariance matrix, $\alpha_R$ denotes a right HRTF representing a transfer path from a location where a sound is generated to a user's right ear, $\alpha_L$ denotes a left HRTF representing a transfer path from a location where a sound is generated to a user's left ear, $\Gamma_{SS}$ denotes a PSD of a target signal, $\Gamma_{NN}$ denotes a PSD of diffuse noise, and $\psi$ denotes coherence between the diffuse noise.

In Equation 19, the covariance matrix $R_x$ with respect to the two-channel signal has an element including $\psi\Gamma_{NN}$. In other words, the eigenvalue estimating unit 220 of the current example considers $\psi\Gamma_{NN}$ in considering a covariance function with respect to the two-channel signal. Thus, the eigenvalue estimating unit 220 may estimate the covariance matrix considering the coherence between the diffuse noise.

Also, the eigenvalue estimating unit 220 may estimate an eigenvalue of a covariance matrix as shown in Equation 20 below.

$$\lambda_{1,2} = \frac{((|\alpha_L|^2 + |\alpha_R|^2)\Gamma_{SS} + 2\Gamma_{NN}) \pm ((|\alpha_L|^2 + |\alpha_R|^2)\Gamma_{SS} + 2\Psi\Gamma_{NN})}{2} \tag{20}$$

In Equation 20, $\lambda_{1,2}$ denotes eigenvalues of covariance matrixes, $\alpha_R$ denotes a right HRTF representing a transfer path from a location where a sound is generated to a user's right ear, $\alpha_L$ denotes a left HRTF representing a transfer path from a location where a sound is generated to a user's left ear, $\Gamma_{SS}$ denotes a PSD of a target signal, $\Gamma_{NN}$ denotes a PSD of diffuse noise, and $\psi$ denotes a coherence between the diffuse noise.

A method of estimating the eigenvalue from the covariance matrix would have been known to one of ordinary skill in the art, and thus a detailed description thereof will be omitted here.

The eigenvalue estimating unit 220 estimates a smaller value among the eigenvalues $\lambda_1$ and $\lambda_2$ of the covariance matrix, which are obtained in Equation 20, as a minimum eigenvalue of the covariance matrix.

The low frequency band compensation unit 230 estimates a PSD of the diffuse noise using the eigenvalue estimated by the eigenvalue estimating unit 220 and the coherence estimated by the coherence estimating unit 120. Thus, the low frequency band compensation unit 230 compensates for a low frequency band in the PSD of the diffuse noise. The estimated PSD of the diffuse noise may be represented by Equation 21 below.

$$\Gamma_{NN} = \frac{\lambda}{1-\Psi} \tag{21}$$

In Equation 21, $\Gamma_{NN}$ denotes a PSD of diffuse noise, $\lambda$ denotes an eigenvalue of a covariance matrix with respect to a two-channel signal, and $\psi$ denotes a coherence between the diffuse noise. As such, the low frequency band compensation unit 230 compensates for a low frequency band of the PSD of the diffuse noise using the coherence estimated by the coherence estimating unit 210 and the eigenvalue of the covariance matrix estimated by the eigenvalue estimating unit 220.

Accordingly, the diffuse noise estimating unit 120 may estimate the PSD of the diffuse noise in which a low frequency band is compensated for using the coherence estimated by the coherence estimating unit 210 and the minimum eigenvalue of the covariance matrix estimated by the eigenvalue estimating unit 220.

The diffuse noise estimating unit 120 estimates the PSD of the diffuse noise in consideration of the coherence between the diffuse noise, thereby improving accuracy of the estimated PSD of the diffuse noise.

Figure 3:
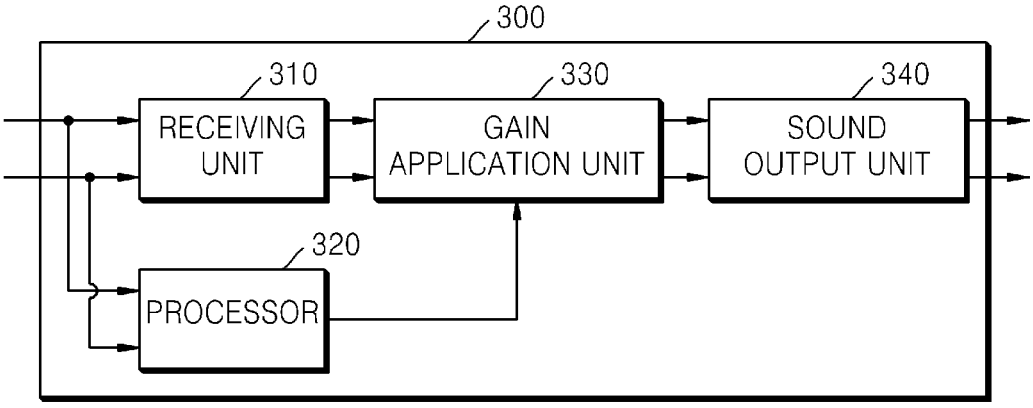
FIG. 3 is a block diagram of an example of a sound output apparatus.

FIG. 3 is a block diagram of an example of a sound output apparatus 300. Referring to FIG. 3, the sound output apparatus 300 includes a receiving unit 310, a processor 320, a gain application unit 330, and a sound output unit 340. The processor 320 includes the noise removing apparatus 100 shown in FIG. 1. The description of the noise removing apparatus 100 of FIG. 1 is also applicable to the processor 320 of FIG. 3, and thus a repeated description thereof will be omitted here.

The sound output apparatus 300 shown in FIG. 3 includes only components related to the current example. Thus, one of ordinary skill in the art would understand that the sound output apparatus 300 may include other general-purpose components in addition to the components shown in FIG. 3.

The sound output apparatus 300 outputs a two-channel sound from which noise is removed. The sound output apparatus 300 of the current example may be configured as a binaural hearing aid, a headset, an earphone, a mobile phone, a personal digital assistant (PDA), a Moving Picture Experts Group (MPEG) Audio Layer III (MP3) player, a compact disc (CD) player, a portable media player, or any other device that produces sound, but the current example is not limited thereto.

The receiving unit 310 receives channel signals constituting a two-channel signal. In this regard, the channel signal is a signal into which a sound around a user is input via two audio channels. Thus, the receiving unit 310 receives the sound divided into two audio channels.

The receiving unit 310 of the current example may be a microphone for receiving a surrounding sound and converting the received sound into an electrical signal. However, the current example is not limited thereto, and any apparatus capable of sensing and receiving a surrounding sound may be used as the receiving unit 310.

According to the current example, the two-channel signal may be sound input at positions of both ears of the user. Thus, the receiving unit 310 may receive a two-channel signal, for example, via microphones respectively placed at a user's left ear and a user's right ear. Hereinafter, for convenience of description, the two-channel signal may be referred to as sounds input at positions of both ears of the user. The sound input at a position of the user's left ear is referred to as a left channel signal, and the sound input at a position of the user's right ear is referred to as a right channel signal.

The processor 320 includes the noise removing apparatus 100 shown in FIG. 1. Thus, the processor 320 obtains a noise signal for each channel by removing a target signal from each channel signal by subtracting another channel signal multiplied by a weighted value from each channel signal, estimates a PSD of diffuse noise from each channel signal, obtains a target signal including an interference signal for each channel by removing the diffuse noise from each channel signal using the estimated PSD of the diffuse noise, obtains the interference signal for each channel by removing the diffuse noise from the noise signal for each channel using the estimated PSD of the diffuse noise, and obtains the target signal for each channel by removing the interference signal from the target signal and the interference signal for each channel as described above with reference to FIG. 1. More details can be found by referring to the description of the diffuse noise estimating unit 120, the target signal removing unit 130, the first diffuse noise removing unit 140, the second diffuse noise removing unit 150, and the interference signal removing unit 160 shown in FIG. 1.

Also, the processor 320 obtains an output gain to be applied to each channel signal based on the obtained target signal. In this regard, the processor 320 obtains an output gain for each channel using the target signal excluding the noise signal including the diffuse noise and the interference signal. The output gain for each channel may be obtained using Equation 22 below.

$$\mathrm{Gain}_L=|\hat{E}_L|^2/\Gamma_{XX}{}^L$$

$$\mathrm{Gain}_R=|\hat{E}_R|^2/\Gamma_{XX}{}^R \tag{22}$$

In Equation 22, $\mathrm{Gain}_L$ and $\mathrm{Gain}_R$ denote output gains for each channel. $\mathrm{Gain}_L$ and $\mathrm{Gain}_R$ refer to a PSD ratio of a PSD of target signals $\hat{E}_L$ and $\hat{E}_R$ estimated by removing the diffuse noise and the interference signal from the channel signals $X_L$ and $X_R$ to the PSD $\Gamma_{XX}{}^L$ and $\Gamma_{XX}{}^R$ of the received channel signal. Thus, the processor 320 obtains $\mathrm{Gain}_L$ and $\mathrm{Gain}_R$, which are output gains for each channel, using the estimated PSD of the target signal for each channel and the PSD of each channel signal.

The sound output apparatus 300 of the current example maintains directionality of each channel signal by multiplying the channel signals $X_L$ and $X_R$ by the same output gain. Thus, the processor 320 obtains an output gain that is equally applied to each channel signal. The output gain may be obtained based on the output gain for each channel as shown in Equation 23 below.

$$G=\sqrt{\mathrm{Gain}_L\cdot\mathrm{Gain}_R} \tag{23}$$

In Equation 23, G denotes an output gain that is equally applied to each channel signal, and $\mathrm{Gain}_L$ and $\mathrm{Gain}_R$ denote output gains for each channel. Thus, the processor 320 may obtain an output gain G that is equally applied to each channel signal using a geometric mean of $\mathrm{Gain}_L$ and $\mathrm{Gain}_R$.

Thus, the sound output apparatus 300 of the current example may minimize a loss of a spatial cue parameter by multiplying each channel signal by the same gain.

The gain application unit 330 applies the output gain obtained by the processor 320 to each channel signal. In this regard, the gain application unit 330 removes noise elements including diffuse noise and an interference signal from each channel signal by multiplying each channel signal by the same output gain G to remove noise while maintaining directionality of each channel signal. Thus, the gain application unit 330 may output a two-channel signal from which noise is removed by applying the same output gain to each channel signal. The two-channel signal obtained by the gain application unit 330 may be represented by Equation 24 below.

$$\hat{S}_L=X_L\cdot G$$

$$\hat{S}_R=X_R\cdot G \tag{22}$$

In Equation 24, $\hat{S}_L$ and $\hat{S}_R$ denote a two-channel signal from which noise is removed from each channel signal. In other words, the gain application unit 330 may remove noise from each channel signal by multiplying the channels signals $X_L$ and $X_R$ by the output gain G.

The sound output unit 340 outputs a two-channel sound to which an output gain is applied by the gain application unit 330. Thus, a user may listen to the two-channel sound from which noise is removed.

The sound output unit 340 of the current example may be configured, for example, as a speaker or a receiver. However, the current example is not limited thereto, and any apparatus capable of outputting a two-channel sound may be used as the sound output unit 340.

The sound output apparatus 300 of the current example estimates diffuse noise and an interference signal and removes them from each channel signal, and thus the sound output apparatus 300 may easily and effectively remove noise without performing a large number of operations as is necessary in an MWF performing an operation using a plurality of input signals.

Also, the sound output apparatus 300 obtains remaining signals, obtained by removing the estimated diffuse noise from the noise signal which is obtained by removing the target, as an interference signal. Thus, the sound output apparatus 300 may easily and effectively remove all interference elements without performing a complex operation, as is necessary in a VAD, even though more than two interference signals exist.

In addition, the sound output apparatus 300 may effectively remove noise without causing a loss of a spatial cue parameter such as an ILD and an ITD between channels by multiplying each channel signal by the same gain.

Figure 4:
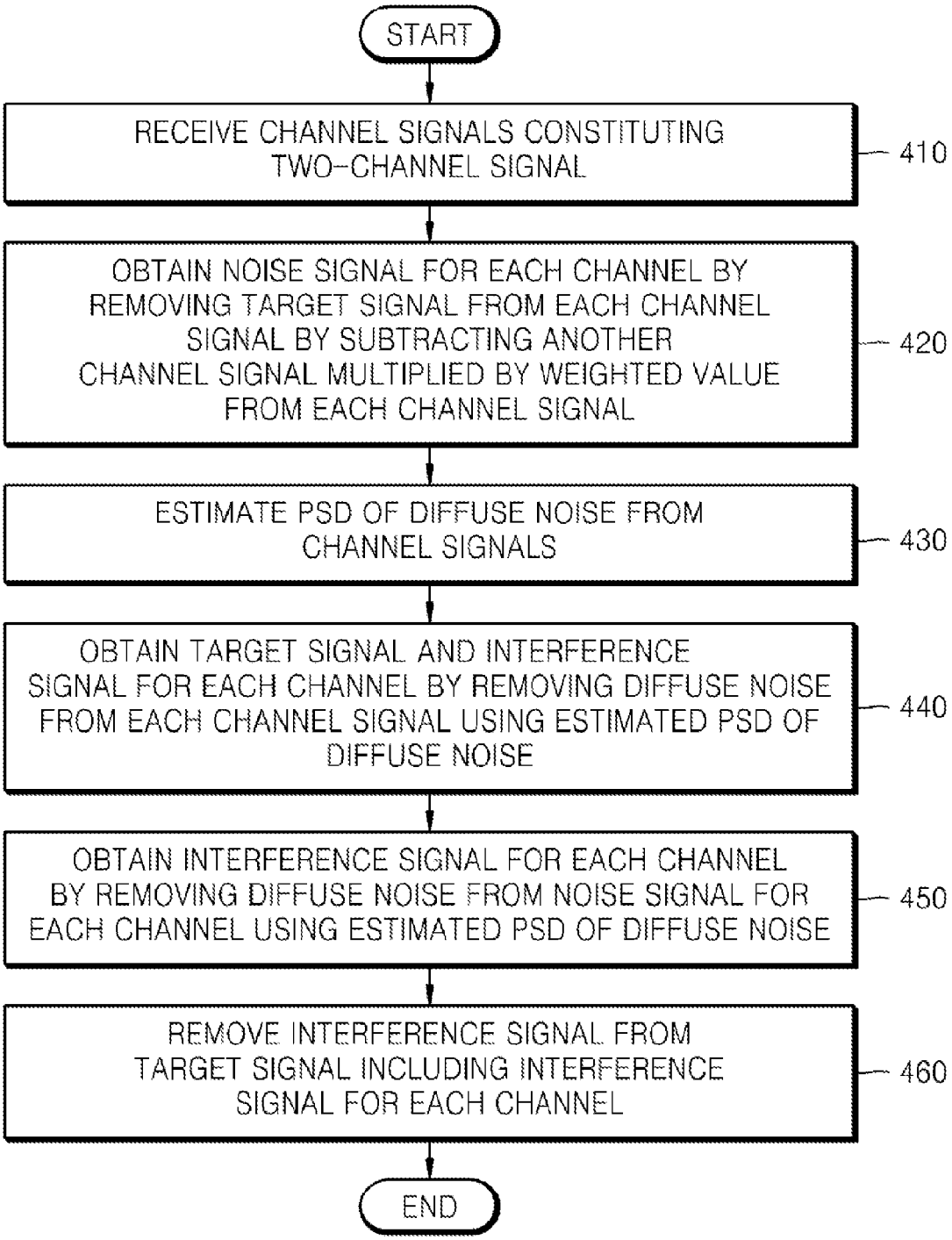
FIG. 4 is a flowchart showing an example of a method of removing noise using a noise removing apparatus of FIG. 1.

FIG. 4 is a flowchart showing an example a method of removing noise using the noise removing apparatus 100 of FIG. 1. Referring to FIG. 4, the method shown in FIG. 4 includes operations that are performed by the noise removing apparatus 100 shown in FIGS. 1 and 2. Thus, although omitted below, the description of the noise removing apparatus 100 shown in FIGS. 1 and 2 is also applicable to the method shown in FIG. 4.

In operation 410, the receiving unit 110 receives channel signals constituting a two-channel signal. In this regard, the channel signal is a signal into which a sound around a user is input via two audio channels. According to the current example, the two-channel signal may be sounds input at positions of both ears of the user.

The channel signal includes a target signal corresponding to sound that a user intends to listen to, and a noise signal excluding the target signal. The noise signal may include diffuse noise corresponding to noise having no directionality, and an interference signal corresponding to noise having directionality.

In operation 420, the target signal removing unit 130 obtains a noise signal for each channel by removing the target signal from each channel signal by subtracting another channel signal multiplied by a weighted value from each channel signal. In this regard, the weighted value may be determined based on directional information of the target signal included in each channel signal.

In operation 430, the diffuse noise estimating unit 120 estimates a PSD of diffuse noise from the channel signals. In greater detail, the diffuse noise estimating unit 120 may estimate a coherence between the diffuse noise included in the channel signals, obtain a minimum eigenvalue of a covariance matrix with respect to the channel signals, and estimate a PSD of the diffuse noise using the estimated coherence and the estimated minimum eigenvalue.

In operation 440, the first diffuse noise removing unit 140 obtains the target signal and the interference signal for each channel by removing the diffuse noise from each channel signal using the PSD of the diffuse noise estimated in operation 430. In this regard, the first diffuse noise removing unit 140 may remove the diffuse noise from each channel signal by multiplying each channel signal by a same first diffuse noise removing gain to remove the diffuse noise while maintaining directionality of the channel signal.

In operation 450, the second diffuse noise removing unit 150 obtains the interference signal for each channel by removing the diffuse noise from the noise signal for each channel using the PSD of the diffuse noise estimated in operation 430. In this regard, the second diffuse noise removing unit 150 may remove the diffuse noise from the noise signal for each channel by multiplying the noise signal for each channel by a same second diffuse noise removing gain to remove the diffuse noise while maintaining directionality of the noise signal for each channel.

In operation 460, the interference signal removing unit 160 removes the interference signal obtained in operation 450 from the target signal and the interference signal obtained in operation 440. In this regard, the interference signal removing unit 160 may remove the interference signal by adaptively removing a signal element having a high coherence with the interference signal from the target signal and the interference signal for each channel using an adaptive filter.

As such, the noise removing apparatus 100 of the current example may obtain the target signal excluding noise by removing the diffuse noise and the interference signal from the received channel signals.

Figure 5:
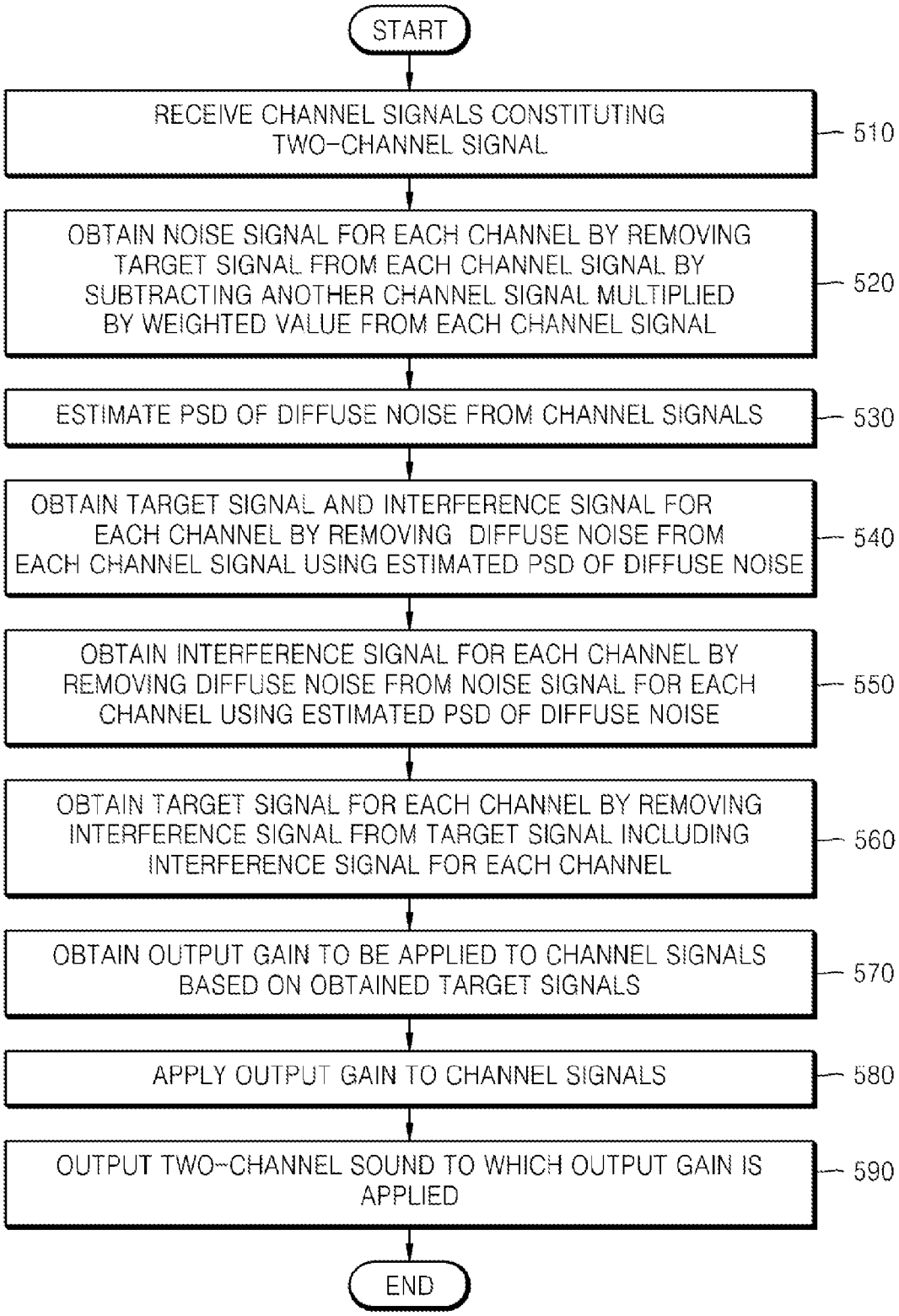
FIG. 5 is a flowchart showing an example of a method of outputting a sound from which noise has been removed using a sound output apparatus of FIG. 3.

FIG. 5 is a flowchart showing an example a method of outputting a sound from which noise has been removed using the sound output apparatus 300 of FIG. 3. Referring to FIG. 5, the method shown in FIG. 5 includes operations that are performed by the noise removing apparatus 100 and the sound output apparatus 300 shown in FIGS. 1 to 3. Thus, although omitted below, the description of the noise removing apparatus 100 and the sound output apparatus 300 shown in FIGS. 1 to 3 is also applicable to the method shown in FIG. 5.

In operation 510, the receiving unit 310 receives channel signals constituting a two-channel signal. In this regard, the receiving unit 310 receives the channel signals by receiving a sound divided into two audio channels. According to the current example, the receiving unit 310 may receive the two-channel signal, for example, via microphones respectively placed at both of the user's ears.

In operation 520, the processor 320 obtains a noise signal for each channel by removing the target signal from each channel signal by subtracting another channel signal multiplied by a weighted value from the channel signals received in operation 510.

In operation 530, the processor 320 estimates a PSD of diffuse noise from the channel signals.

In operation 540, the processor 320 obtains a target signal including an interference signal for each channel by removing the diffuse noise from the channel signals using the PSD of the diffuse noise estimated in operation 530.

In operation 550, the processor 320 obtains the interference signal for each channel by removing the diffuse noise from the noise signal for each channel using the PSD of the diffuse noise estimated in operation 530.

In operation 560, the processor 320 obtains the target signal for each channel by removing the interference signal obtained in operation 550 from the target signal and the interference signal obtained in operation 540.

In operation 570, the processor 320 obtains an output gain to be applied to the channel signals based on the target signals obtained in operation 560.

In operation 580, the gain application unit 330 applies the output gain obtained in operation 570 to the channel signals.

In operation 590, the sound output unit 340 outputs a two-channel sound to which the output gain is applied in operation 580.

As such, the sound output apparatus 300 of the current example outputs the two-channel sound from which the diffuse noise and the interference signal are removed. Thus, the sound output apparatus 300 may output a sound having directionality of the channel signals by minimizing a loss of a spatial cue parameter in the received two-channel signal. Also, the sound output apparatus 300 may output the target signal from which noise is completely removed without signal distortion, thereby improving a user's sound recognition ability and a sound quality.

According to the above description, a noise removing apparatus estimates diffuse noise and an interference signal in each channel signal, and removes the interference signal and the diffuse noise, which are noise elements, from the channel signal based on the estimated diffuse noise and the estimated interference signal, and thus the noise removing apparatus can easily and effectively remove noise.

Also, the noise removing apparatus obtains remaining signals, obtained by removing the estimated diffuse noise from the noise signal that is obtained by removing the target signal, as an interference signal. Thus, the noise removing apparatus can easily and effectively remove all interference elements without performing a complex operation even though more than two interference signals exist.

In addition, the noise removing apparatus can effectively remove noise while maintaining directionality of each channel signal without causing a loss of a spatial cue parameter such as an ILD and an ITD between channels by multiplying each channel signal by the same gain.

The noise removing apparatus 100, the receiving unit 110, the diffuse noise estimating unit 120, the target signal removing unit 130, the first diffuse noise removing unit 140, the second diffuse noise removing unit 150, the interference signal removing unit 160, the coherence estimating unit 210, the eigenvalue estimating unit 220, the low frequency band compensation unit 230, the sound output apparatus 300, the processor 320, the gain application unit 330, and the sound output unit 340 described above that perform the operations illustrated in FIGS. 4 and 5 may be implemented using one or more hardware components, one or more software components, or a combination of one or more hardware components and one or more software components.

A hardware component may be, for example, a physical device that physically performs one or more operations, but is not limited thereto. Examples of hardware components include resistors, capacitors, inductors, power supplies, frequency generators, operational amplifiers, power amplifiers, low-pass filters, high-pass filters, band-pass filters, analog-to-digital converters, digital-to-analog converters, and processing devices.

A software component may be implemented, for example, by a processing device controlled by software or instructions to perform one or more operations, but is not limited thereto. A computer, controller, or other control device may cause the processing device to run the software or execute the instructions. One software component may be implemented by one processing device, or two or more software components may be implemented by one processing device, or one software component may be implemented by two or more processing devices, or two or more software components may be implemented by two or more processing devices.

A processing device may be implemented using one or more general-purpose or special-purpose computers, such as, for example, a processor, a controller and an arithmetic logic unit, a digital signal processor, a microcomputer, a field-programmable array, a programmable logic unit, a microprocessor, or any other device capable of running software or executing instructions. The processing device may run an operating system (OS), and may run one or more software applications that operate under the OS. The processing device may access, store, manipulate, process, and create data when running the software or executing the instructions. For simplicity, the singular term "processing device" may be used in the description, but one of ordinary skill in the art will appreciate that a processing device may include multiple processing elements and multiple types of processing elements. For example, a processing device may include one or more processors, or one or more processors and one or more controllers. In addition, different processing configurations are possible, such as parallel processors or multi-core processors.

A processing device configured to implement a software component to perform an operation A may include a processor programmed to run software or execute instructions to control the processor to perform operation A. In addition, a processing device configured to implement a software component to perform an operation A, an operation B, and an operation C may have various configurations, such as, for example, a processor configured to implement a software component to perform operations A, B, and C; a first processor configured to implement a software component to perform operation A, and a second processor configured to implement a software component to perform operations B and C; a first processor configured to implement a software component to perform operations A and B, and a second processor configured to implement a software component to perform operation C; a first processor configured to implement a software component to perform operation A, a second processor configured to implement a software component to perform operation B, and a third processor configured to implement a software component to perform operation C; a first processor configured to implement a software component to perform operations A, B, and C, and a second processor configured to implement a software component to perform operations A, B, and C, or any other configuration of one or more processors each implementing one or more of operations A, B, and C. Although these examples refer to three operations A, B, C, the number of operations that may implemented is not limited to three, but may be any number of operations required to achieve a desired result or perform a desired task.

Software or instructions for controlling a processing device to implement a software component may include a computer program, a piece of code, an instruction, or some combination thereof, for independently or collectively instructing or configuring the processing device to perform one or more desired operations. The software or instructions may include machine code that may be directly executed by the processing device, such as machine code produced by a compiler, and/or higher-level code that may be executed by the processing device using an interpreter. The software or instructions and any associated data, data files, and data structures may be embodied permanently or temporarily in any type of machine, component, physical or virtual equipment, computer storage medium or device, or a propagated signal wave capable of providing instructions or data to or being interpreted by the processing device. The software or instructions and any associated data, data files, and data structures also may be distributed over network-coupled computer systems so that the software or instructions and any associated data, data files, and data structures are stored and executed in a distributed fashion.

For example, the software or instructions and any associated data, data files, and data structures may be recorded, stored, or fixed in one or more non-transitory computer-readable storage media. A non-transitory computer-readable storage medium may be any data storage device that is capable of storing the software or instructions and any associated data, data files, and data structures so that they can be read by a computer system or processing device. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMS, BD-ROMs, BD-Rs, BD-R LTHs, BD-REs, magnetic tapes, floppy disks, magneto-optical data storage devices, optical data storage devices, hard disks, solid-state disks, or any other non-transitory computer-readable storage medium known to one of ordinary skill in the art.

Functional programs, codes, and code segments for implementing the examples disclosed herein can be easily constructed by a programmer skilled in the art to which the examples pertain based on the drawings and their corresponding descriptions as provided herein.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the detailed description.

What is claimed is:

1. A method of removing noise from a two-channel sound signal, the method comprising:

receiving, by a processor, channel sound signals constituting the two-channel sound signal;

obtaining, by the processor, a noise signal for each channel by removing a target sound signal from each channel sound signal by subtracting other channel sound signal multiplied by a weighted value from each channel sound signal;

estimating, by the processor, a power spectral density PSD of a diffuse noise from each channel sound signal;

obtaining, by the processor, a first sound signal comprising a target signal and an interference signal for each channel by removing the diffuse noise from each channel sound signal using the estimated PSD of the diffuse noise;

obtaining, by the processor, a first diffuse noise removing gain based on a PSD of each channel sound signal and the estimated PSD of the diffuse noise;

obtaining, by the processor, a second diffuse noise removing gain based on a PSD of the noise signal for each channel, the estimated PSD of the diffuse noise, and directional information of the target signal for each channel;

obtaining, by the processor, the PSD of each channel sound signal through a first-order recursive averaging of each channel sound signal; and obtaining, by the processor, the PSD of the noise signal for each channel through a first-order recursive averaging of the noise signal for each channel;

obtaining, by the processor, the interference signal for each channel by removing the diffuse noise from the noise signal for each channel using the estimated PSD of the diffuse noise;

removing, by the processor, the interference signal from the first sound signal, wherein the obtaining of the first sound signal comprises removing the diffuse noise from each channel sound signal by multiplying the channel sound signals by the first diffuse noise removing gain to remove the diffuse noise while maintaining directionality of the channel sound signals, and wherein the obtaining of the interference signal for each channel comprises removing the diffuse noise from each channel sound signal by multiplying the noise signal for each channel by the second diffuse noise removing gain to remove the diffuse noise while maintaining directionality of the noise signal for each channel.

2. The method of claim 1, further comprising determining the weighted value based on directional information of the target signal of each channel sound signal.

3. The method of claim 1, wherein the estimating of the PSD of the diffuse noise comprises:

estimating a coherence between the diffuse noise of each of the channel sound signals;

estimating a minimum eigenvalue of a covariance matrix with respect to the two-channel sound signal; and estimating the PSD of the diffuse noise using the estimated coherence and the minimum eigenvalue.

4. The method of claim 1, wherein the removing of the interference signal comprises removing the interference signal by adaptively removing a signal component having a high coherence with the interference signal from the first sound signal using an adaptive filter.

5. The method of claim 4, wherein the adaptive filter is configured using a normalized least means square (NLMS) algorithm.

6. A non-transitory computer-readable storage medium storing a computer program for controlling a computer to perform the method of claim 1.

7. A noise removing apparatus for removing noise from a two-channel sound signal, the noise removing apparatus comprising a processor that comprises:

a receiving unit configured to receive channel sound signals constituting the two-channel sound signal;

a target signal removing unit configured to obtain a noise signal for each channel by removing a target signal from each channel sound signal by subtracting other channel sound signal multiplied by a weighted value from each channel sound signal;

a diffuse noise estimating unit configured to estimate a power spectral density PSD of a diffuse noise from each channel sound signal and obtain the PSD of the noise signal for each channel through a first-order recursive averaging of the noise signal for each channel;

a first diffuse noise removing unit configured to obtain a first sound signal comprising a target signal and an interference signal for each channel by removing the diffuse noise from each channel sound signal using the estimated PSD of the diffuse noise and obtain a PSD of each channel sound signal through a first-order recursive averaging of each channel sound signal;

a second diffuse noise removing unit configured to obtain the interference signal for each channel by removing the diffuse noise from each channel sound signal using the estimated PSD of the diffuse noise and obtain the PSD of each channel sound signal through a first-order recursive averaging of each channel sound signal; and an interference signal removing unit configured to remove the interference signal from the first sound signal.

8. The noise removing apparatus of claim 7, wherein the target signal removing unit is further configured to determine the weighted value based on directional information of the target signal of each channel sound signal.

9. The noise removing apparatus of claim 7, wherein the diffuse noise estimating unit is further configured to:

estimate a coherence between the diffuse noise of each of the channel sound signals;

estimate a minimum eigenvalue of a covariance matrix with respect to the two-channel sound signal; and estimate a PSD of the diffuse noise using the estimated coherence and the estimated minimum eigenvalue.

10. The noise removing apparatus of claim 7, wherein the first diffuse noise removing unit is further configured to remove the diffuse noise from the channel sound signals by multiplying the channel sound signals by a first diffuse noise removing gain to remove the diffuse noise while maintaining directionality of the channel sound signals; and the second diffuse noise removing unit is further configured to remove the diffuse noise from the noise signal for each channel by multiplying the noise signal for each channel by a second diffuse noise removing gain to remove the diffuse noise while maintaining directionality of the noise signal for each channel.

11. The noise removing apparatus of claim 10, wherein the first diffuse noise removing unit is further configured to obtain the first diffuse noise removing gain based on the PSD of each channel sound signal and the estimated PSD of the diffuse noise; and the second diffuse noise removing unit is further configured to obtain the second diffuse noise removing gain based on the PSD of the noise signal for each channel, the estimated PSD of the diffuse noise, and directional information of the target signal for each channel.

12. The noise removing apparatus of claim 7, wherein the interference signal removing unit is further configured to remove the interference signal by adaptively removing a signal component having a high coherence with the interference signal from the first sound signal using an adaptive filter.

13. A sound output apparatus for outputting a two-channel sound from which noise is removed, the sound output apparatus comprising:

a receiving unit configured to receive channel sound signals constituting the two-channel sound signal;

a processor configured to:

obtain a noise signal for each channel by removing a target signal from each channel sound signal by subtracting other channel sound signal multiplied by a weighted value from each channel sound signal;

estimate a power spectral density PSD of the diffuse noise from each channel sound signal;

obtain a first sound signal comprising a target signal and an interference signal for each channel by removing the diffuse noise from each channel sound signal using the estimated PSD of the diffuse noise;

obtain the interference signal for each channel by removing the diffuse noise from the noise signal for each channel using the estimated PSD of the diffuse noise;

obtain the target signal for each channel by removing the interference signal from the target signal comprising the interference signal for each channel; and obtain an output gain applied to each channel sound signal based on the obtained target signal;

obtain the first diffuse noise removing gain based on a PSD of each channel sound signal and the estimated PSD of the diffuse noise;

obtain the second diffuse noise removing gain based on a PSD of the noise signal for each channel, the estimated PSD of the diffuse noise, and directional information of the target signal for each channel;

obtain the PSD of each channel sound signal through a first-order recursive averaging of each channel sound signal; and obtain the PSD of the noise signal for each channel through a first-order recursive averaging of the noise signal for each channel;

a gain application unit configured to apply the output gain to each channel sound signal; and a sound output unit configured to output a two-channel sound to which the output gain is applied.

14. The sound output apparatus of claim 13, wherein the gain application unit is further configured to apply the same output gain to each channel sound signal to remove noise while maintaining a directionality of each channel sound signal.

15. The sound output apparatus of claim 13, wherein the processor is further configured to obtain the weighted value based on directional information of the target signal of each channel sound signal.

16. The sound output apparatus of claim 13, wherein the processor is further configured to estimate a coherence between the diffuse noise of each of the channel sound signals, estimate a minimum eigenvalue of a covariance matrix with respect to the two-channel sound signal, and estimate the PSD of the diffuse noise using the estimated coherence and the estimated minimum eigenvalue.

17. The sound output apparatus of claim 13, wherein the processor is further configured to remove the interference signal by adaptively removing a signal component having a high coherence with the interference signal from the first sound signal using an adaptive filter.

* * * * *